US007360279B2

(12) United States Patent
Hoffmann et al.

(10) Patent No.: US 7,360,279 B2
(45) Date of Patent: Apr. 22, 2008

(54) ADJUSTABLE HINGE

(75) Inventors: Rainer Hoffmann, Langenfeld (DE); Markus Schmitz, Herne (DE)

(73) Assignee: EMKA Beschlagteile GmbH & Co. KG (DE)

( * ) Notice: Subject to any disclaimer, the term of this patent is extended or adjusted under 35 U.S.C. 154(b) by 239 days.

(21) Appl. No.: 11/203,582

(22) Filed: Aug. 5, 2005

(65) Prior Publication Data

US 2006/0026796 A1 Feb. 9, 2006

(30) Foreign Application Priority Data

Aug. 5, 2004 (DE) ..... 20 2004 012 344 U

(51) Int. Cl.
*E05D 5/00* (2006.01)

(52) U.S. Cl. ..... 16/382; 16/237

(58) Field of Classification Search ..... 16/382, 16/235, 236–238, 245, 246; 411/104, 539
See application file for complete search history.

(56) References Cited

U.S. PATENT DOCUMENTS 566,323 A * 8/1896 Kelleher et al. ..... 16/249
2,477,429 A * 7/1949 Swanstrom et al. ..... 411/111
3,053,355 A * 9/1962 Attwood ..... 403/22
4,575,295 A * 3/1986 Rebentisch ..... 411/85
4,881,296 A * 11/1989 Marinoni ..... 16/237
5,385,383 A * 1/1995 Kreis et al. ..... 296/202
6,286,185 B1 * 9/2001 Ramsauer ..... 16/236
6,502,282 B1 * 1/2003 King ..... 16/382
6,733,221 B2 * 5/2004 Linger ..... 411/84

FOREIGN PATENT DOCUMENTS

DE 29514712 2/1997

* cited by examiner

*Primary Examiner*—Chuck Y. Mah
(74) *Attorney, Agent, or Firm*—Robert W. Becker; Robert W. Becker & Assoc.

(57) ABSTRACT

A hinge for a door or cover of a cabinet includes first and second hinge wings. Each wing has a plurality of openings for receiving attachment screws that penetrate associated bores in components to be held together by means of the hinge. An adapter is positioned on a back side of each of the components. Each adapter has a projection centered in the bores of the components for receiving a respective screw nut, wherein each screw nut cooperates with one of the attachment screws. A diametrically extending slotted hole disposed in each of the adapters provides for positive-fit, non-rotatable receipt of the screw nut that is displaceable in the slotted hole. Preferably, the diameter of the bores located in the components is greater than a diameter of the attachment screws by the amount of displaceability of the hinge. In this manner, the hinge can be adjusted without detracting from the outward appearance of the hinge on the cabinet door.

5 Claims, 2 Drawing Sheets

ADJUSTABLE HINGE

BACKGROUND OF THE INVENTION

The invention relates to a hinge comprising a first and second hinge wing each with multiple openings for receiving attachment screws penetrate associated bores in components that are to be held together by means of the hinge, whereby both hinge wings are connected to one another by means of a hinge pin.

A hinge with the above features is described in DE 295 14 712 U1. With regard to such a hinge being used in particular with sheet metal cabinets, the problem exists generally that the components to be held together by means of the hinge, such as the cabinet body and associated door or covers, can buckle so that difficulties can occur when mounting the hinge. To avoid these types of mounting difficulties it is provided with the known hinge that the openings in the hinge wings to receive the attachment screws are formed as slotted holes, whereby the orientation of the slotted holes in one of the hinge wings runs essentially perpendicular to the orientation in the other hinge wing. In this manner, already a two-dimensional orientation possibility for the hinge is created.

A disadvantage is connected with the known hinge, in that the hinge is displaceable, respectively, only in the axis of the slotted hole; therefore, the appearance of the hinge on its outer visible side is adversely affected by the slotted holes seen there.

SUMMARY OF THE INVENTION

The invention is therefore based on the object of improving the adjustability of the hinge with the above features such that this adjustability cannot be seen on the visible side of the hinge The present invention contemplates in its basic concept that on the backside of the components, respectively, an adapter is disposed. The adapter is centered via a projection in the bores of the component for receiving a screw nut that cooperates with the attachment screw. In the adapter, a diametrically extending slotted hole for positive-fit, non-rotatable receipt of the screw nut, which is displaceable in the slotted hole, is formed. The diameter of the bores located in the components is greater than the diameter of the attachment screws by the amount of the displaceability of the hinge. Thus, the present invention relates to the principle that the adjustment of the hinge wing, respectively, takes place by rotation of the associated adapter by adjustment of its slot hole in the direction of the desired displacement of the hinge wing; since the adapter is centered by means of its centering projection in a bore of the corresponding component having a greater diameter than the diameter of the attachment screw, a rotation of the adapter causes the screw nut fixed by the premounted attachment screw to be positively displaced into the slot of the adapter. Thereby, the attachment screw is taken along in connection with the play of movement defined by the size of the bore in the component. Thus, a displacement of the attachment screw, and hence of the hinge wing held in a positive-locking manner by this in the countersunk openings, is possible in any direction without limitation. Since on the front visible side of the hinge the attachment screw sits integrative in the associated, countersunk opening of the respective hinge wing, the adjustment possibility of the hinge wing on the visible side of the hinge cannot be seen; it is not different from common hinges, which likewise brings the advantage that the hinge wing can be made unchanged for a use with or without adjustment.

According to one embodiment of the present invention, it is provided that the slotted hole formed in the body of the adapter is delimited on both sides by grooves that bound the screw nut at its edge regions and guide it upon its displacement in the slotted hole. This ensures that the positive displacement of the screw nut in the slotted hole of the adapter, which takes place in a positively guided manner when adjusting a hinge wing, occurs without problems.

According to one embodiment of the invention, it is provided that the slotted hole is formed to be open on one side for insertion of the screw nut. According to the invention, it is also possible that the screw nut can be incorporated into the slotted hole during manufacture of the adapter.

According to one embodiment of the invention, it is provided that the body of the adapter projecting away from the component has a multi-sided form for application of an appropriate tool at its free end, so that a good manipulation with the rotation of the adapter that is necessary for adjustment of the hinge is permitted.

It also can be provided that the centering projection of the adapter is in the form of two oppositely disposed half shells oriented in the direction of the slotted hole; in this manner, the friction of the adapter relative to the edge regions of the bore in the associated component receiving the half shells is reduced, whereby the half shells increase the stability of the centering of the adapter in the bore of the component in the direction of the displacement of the screw nut.

DESCRIPTION OF SPECIFIC EMBODIMENTS

Figure 1:
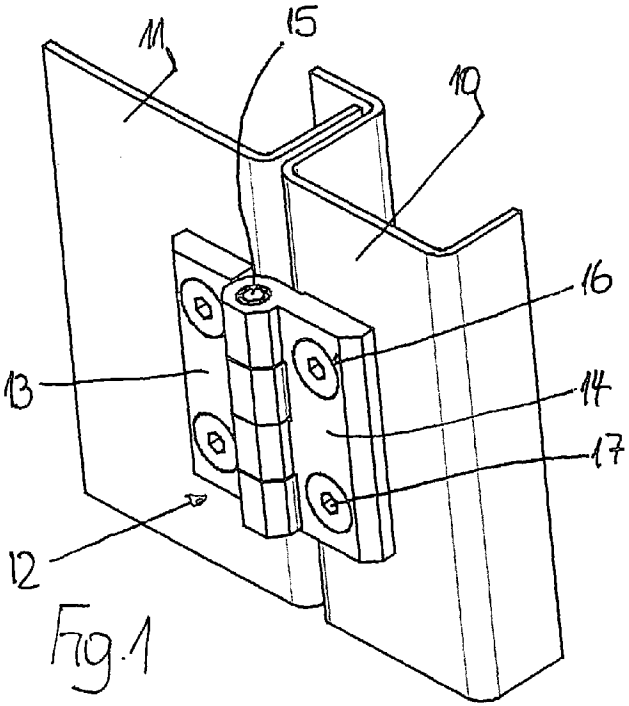
FIG. 1 shows a door mounted on a cabinet body by means of a hinge in a partial view of the visible side of the hinge.
Figure 2:
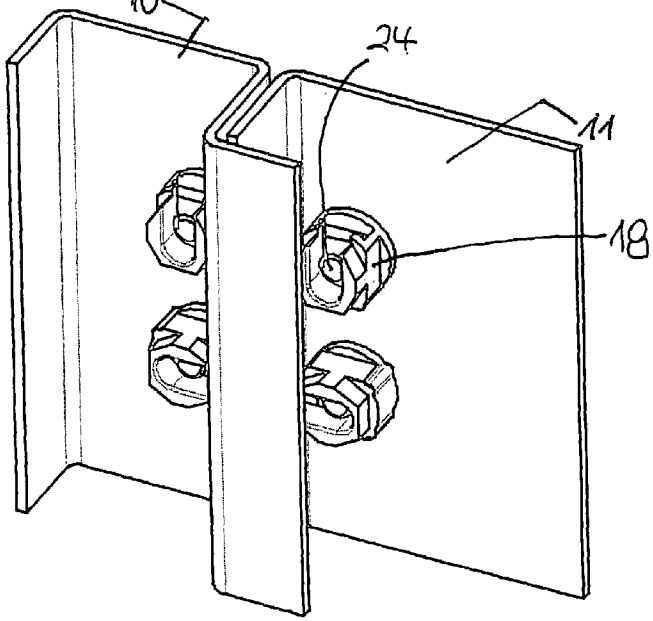
FIG. 2 shows the subject matter of FIG. 1 in a view from behind.
Figure 3:
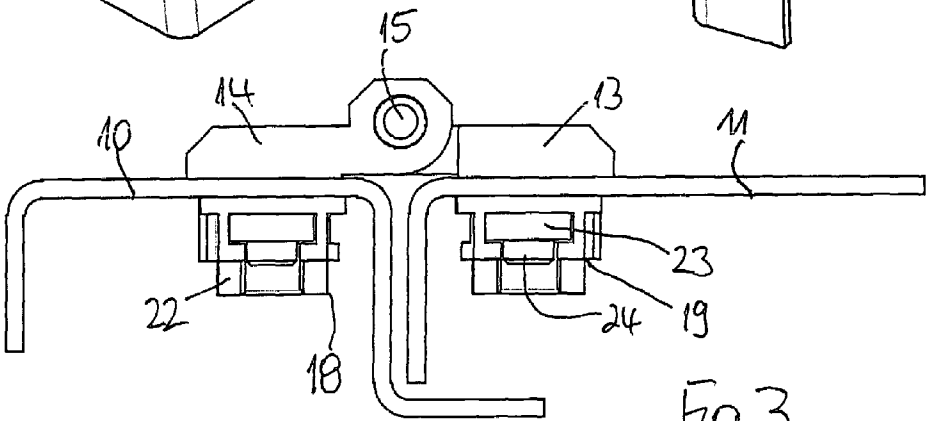
FIG. 3 shows the subject matter of FIGS. 1 and 2 in a plan view.

As shown in FIGS. 1 through 3, a hinge 12 serves for holding a door 11 to a cabinet body 10. The hinge 12 comprises a first hinge wing 13 attached to the cabinet body 10 and a second hinge wing 14 attached to the door 11, whereby both hinge wings are connected or coupled to one another by means of a hinge pin 15. The attachment of the hinge wings 13, 14 takes place via attachment screws 17 having corresponding countersunk openings 16, whereby the attachments crews 17 engage through the cabinet body 10 or the door 11 into a bore (not visible). With regard to the screw shafts 24 of the attachments screws 17 on the back side of the cabinet body 10 and door 11 (FIG. 1), the attachment of the hinge 12 takes place in the manner explained below.

Figure 5:
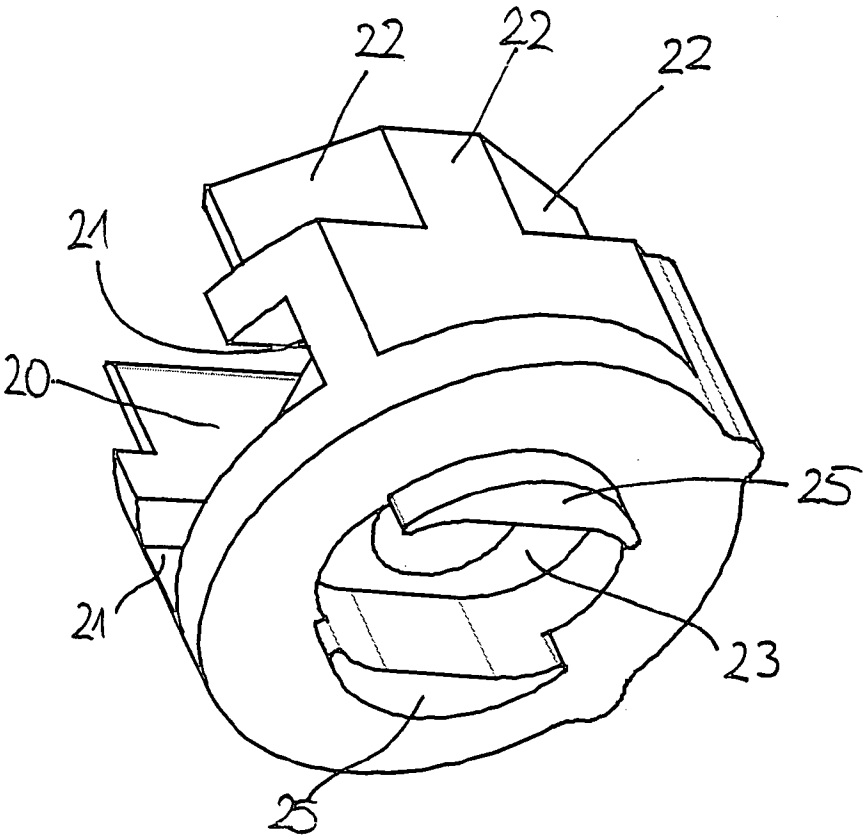
FIG. 5 shows the adapter according to FIG. 4 in another view.
Figure 4:
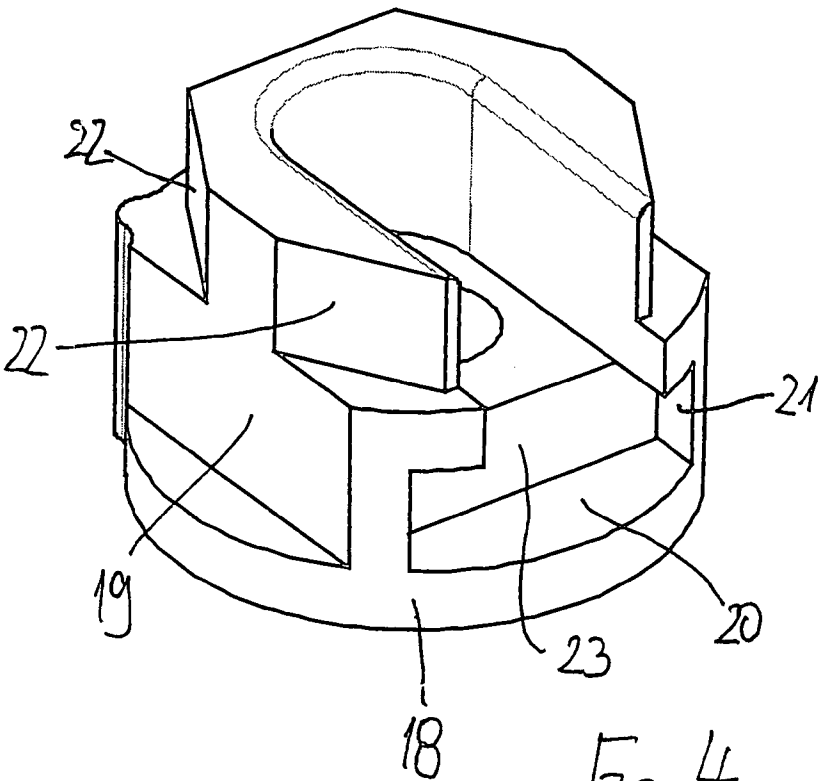
FIG. 4 shows the adapter for the hinge attachment in a detail view.

An adapter 18 is placed onto each screw shaft 24 and this adapter 18 is centered, via a centering projection (FIG. 5) that comprises two oppositely disposed half shells 25, in the associated bore in the cabinet body 10 or door 11. This bore has a greater diameter than the diameter of the attachment screw 17, so that the attachment screw 17 is movable with its screw shaft 24 in the bore of the cabinet body 10 or door 11.

The degree of the diameter enlargement of the bore depends on the desired amount of displaceability of the hinge 12 on the surface of the cabinet body 10 or door 11.

The adapter 18 has formed in its body 19 a diametric slotted hole 20, which is defined on both sides by grooves 21. In the grooves 21, a screw nut 23 is inserted in such a way that the screw nut 23 is displaceable in the grooves 21 or in the slotted hole 20, but is generally non-rotatable relative to the adapter 18. The screw shaft 24 of the attachment screw 17 can be screwed into the screw nut 23.

The region of the body 19 of the adapter 18 projecting from the cabinet body 10 or door 11 is in the form of a multi-sided element 22, so that by means of a corresponding tool to be placed on the multi-sided element 22, the adapter 18 with its centering projection in the form of the half shells 25 can be rotated in the bore of the cabinet body 10 or door 11.

During the mounting of the hinge, first the hinge is premounted by screwing in the attachment screws 17 into the screw nuts 23 inserted into the slotted hole 20 of the rear-placed adaptor 18, so that the hinge 12 already is pre-fixed on the cabinet body 10 or door 11. If an adjustment of the hinge 12 is then necessary, the adapter 18 can be rotated by means of the tool placed on the multi-sided element 22 of the adapter 18. Based on the fixing of the screw nut 23 by the attachment screw 17 into the slot 20 upon rotation of the adapter 18, a positive displacement of the screw nut 23 into the slotted hole 20 takes place. Thus, the slotted hole 20 of the adapter 28 is rotated in the direction, in which the adjustment of the hinge is to take place by a unidirected movement of the screw shaft 24 in the associated bore of the cabinet body 10 or door 11. When the desired adjusted position and location of the screw shaft 24 in the associated bore is achieved, the attachment screw 17 is tightened.

With the pre-mounting of the hinge 12 by placement of the adapter 18, at the beginning of the screwing-in of the attachment screw 17, into the screw nut 23 inserted into the adapter 18, the adjustment of the adapter 18 with the slotted hole 20 can take place in different directions with one hinge wing 13, 14, so that the greatest possible clearance is provided with adjustment of the related hinge wing.

The features of the subject matter of this disclosure provided in the foregoing description, in the patent claims, and the drawings can be important individually as well as in any combinations with one another for realization of the invention it is various embodiments.

The specification incorporates by reference the disclosure of German priority document DE 20 2004 012 344.4 filed Aug. 5, 2004.

The present invention is, of course, in no way restricted to the specific disclosure of the specification and drawings, but also encompasses any modifications within the scope of the appended claims.

The invention claimed is:

1. A hinge, comprising:

first and second hinge wings, each wing having a plurality of openings for receiving attachment screws that penetrate associated bores in components that are to be held together by means of the hinge, each of said components having a front side and a back side, wherein the first and second hinge wings are attached to the respective front side and are connected to one another via a hinge pin;

a plurality of adapters disposed on the back side of each of the components, wherein for receiving a respective screw nut, each adapter has a projection centered in the bores of the components, wherein each said screw nut cooperates with one of the attachment screws; and a diametric slotted hole disposed in each of the adapters for positive-fit, non-rotatable receipt of the screw nut, said screw nut being displaceable in the slotted hole, wherein the diameter of the bores located in the components of the hinge is greater than a diameter of the attachment screws by the amount of displaceability.

2. The hinge of claim 1, wherein the slotted hole is formed in a body of the adapter, wherein the slotted hole is delimited on two sides by grooves that bound the screw nut at edge regions, and wherein upon displacement of the screw nut in the slotted hole, the screw nut is guided by said grooves.

3. The hinge of claim 1, wherein the slotted hole is formed to be open on one side for insertion of the screw nut.

4. The hinge of claim 2, wherein the body of the adapter has a multi-sided element on a free end for placement of a tool.

5. The hinge of claim 1, wherein the projection of the adapter is formed as two oppositely disposed half shells, wherein the two oppositely disposed half shells are oriented in a direction that is the same as an orientation direction of the slotted hole.

* * * * *